United States Patent [19]

Gray

[11] 4,123,376

[45] * Oct. 31, 1978

[54] PEROXYMONOSULFATE-BASE BLEACHING AND BLEACHING DETERGENT COMPOSITIONS

[75] Inventor: Frederick W. Gray, Summit, N.J.

[73] Assignee: Colgate-Palmolive Company, New York, N.Y.

[ * ] Notice: The portion of the term of this patent subsequent to Jun. 7, 1994, has been disclaimed.

[21] Appl. No.: 702,395

[22] Filed: Jul. 6, 1976

Related U.S. Application Data

[63] Continuation-in-part of Ser. No. 391,058, Aug. 24, 1973, Pat. No. 4,028,263.

[51] Int. Cl.[2] ..... C11D 7/56

[52] U.S. Cl. ..... 252/99; 252/95; 252/97; 252/102; 252/89; 252/186

[58] Field of Search ..... 252/95, 97, 99, 102, 252/89, 186

[56] References Cited

U.S. PATENT DOCUMENTS

| | | | |
|---|---|---|---|
| 3,177,148 | 4/1965 | Bright et al. | 252/99 |
| 3,458,446 | 7/1969 | Diaz | 252/95 X |
| 3,583,924 | 6/1971 | Demangeon | 252/102 |
| 3,779,931 | 12/1973 | Fries et al. | 252/102 X |
| 3,982,892 | 9/1976 | Gray | 252/102 |

FOREIGN PATENT DOCUMENTS

| | | | |
|---|---|---|---|
| 2,061,862 | 6/1972 | Fed. Rep. of Germany | 252/102 |

*Primary Examiner*—Mayer Weinblatt

*Attorney, Agent, or Firm*—Herbert S. Sylvester; Murray M. Grill; Raymond F. Kramer

[57] ABSTRACT

A bleaching composition, effective to remove stains on fabrics and safe for dyed fabrics, includes a water soluble peroxymonosulfate bleach, a water soluble inorganic bromide which promotes the bleaching activity of the peroxymonosulfate and an N-hydrogen compound of a certain type, such as para-toluene sulfonamide or 5,5-dimethylhydantoin, which inhibits destruction of dyes and overbleaching of dyed materials while stains to be bleached by the composition are effectively removed. Also within the invention are bleaching detergent compositions which also contain a normally solid, water soluble synthetic organic detergent, such as an anionic detergent which is a sodium linear higher alkylbenzene sulfonate or a nonionic detergent which is a fatty alcohol polyethylene oxide condensate, or a mixture thereof, and which may also include a builder salt. Methods of bleaching and simultaneously washing and bleaching with such compositions or their components are also disclosed.

10 Claims, No Drawings

PEROXYMONOSULFATE-BASE BLEACHING AND BLEACHING DETERGENT COMPOSITIONS

This application is a continuation-in-part of my copending application, Ser. No. 391,058, for Bleaching and Brightening Detergent Compositions, filed Aug. 24, 1973, issued as U.S. Pat. No. 4,028,263 on June 7, 1977.

This invention relates to a bleaching composition, a method of bleaching, a bleaching detergent composition and a method of washing and bleaching. More particularly, it relates to bleaching compositions and bleaching detergent compositions and to methods for their use, which are characterized by improved safety to fluorescent brighteners which may be present and/or to dyed fabrics being treated.

The desirability of bleaches, bleaching detergents, methods of bleaching and methods of simultaneously washing and bleaching being made safer to dyed materials being treated by such compositions or by such methods has long been recognized and much work has been done in attempts to produce effective bleaches which are safe to materials being treated. The problem is a difficult one because the mechanism of bleaching, usually oxidation, while effective in chemically changing objectionable colored stains to uncolored compounds or otherwise assisting in their removal from substrates, may have a similar effect on dyed or otherwise colored materials from which the removal of color is undesirable. Therefore, for many years it has been customary to bleach only white goods and it has been reluctantly accepted that colored or dyed materials that have been stained will be incapable of being bleached back to unstained condition without dye changes. Despite the practical difficulties encountered various stains are more susceptible to bleaching than are the dyes usually employed to color fabrics and therefore, if the strength of the bleach can be accurately controlled it is theoretically possible for the stains to be bleached out while the dyed fabrics remain unaffected or sufficiently unaffected to be unobjectionable. Chlorine bleaches, such as sodium hyprochlorite solutions, often lower brightener efficacy and adversely affect colors of dyed fabrics when they are used to remove stains from a washing machine load. Oxygen bleaches, e.g., sodium perborate, when employed at temperatures below the boil, often will not adversely affect dyed materials but because they are generally very weak bleaches unless activated, they will usually be unsatisfactory in their stain-removing properties. Activated peroxymonosulfates, such as those activated by sodium bromide, as described in parent U.S. Pat. No. 4,028,263, while usually effective bleaches and useful components of bleaching detergent compositions, can have detrimental effects on the more sensitive of the various dyes employed for coloring fabrics and textiles and can oxidize and destroy optical dyes or fluorescent brighteners, which are often desirably incorporated in bleaching compositions and in bleaching detergent compositions. Therefore, it has been an object of the present invention to produce an effective bleaching composition which will satisfactorily bleach or otherwise remove stains from stained fabrics without overbleaching of dyed materials also present in the bleaching medium. Also an object of the invention is to make such bleaching compositions which do not destroy dyes, such as fabric dyes and fluorescent brightening dyes which may be employed in or with the bleaches. Still another object of the invention is to prevent white fabrics from being stained by dye transfer or "bleeding" of dye onto them from colored items when white and colored items are washed together. More specifically, color damage and dye transfer problems associated with fugitive bleach sensitive dyed fabrics are decreased by forming in situ an activated peroxymonosulfate bleach system which is stronger then peroxymonosulfate (or perborate) alone in solution but is safer to colors of dyed fabrics (and to brighteners) than is the direct use of a halogen bleach or one generated from peroxymonosulfate and sodium bromide. Other objects of the invention include the manufacture of bleaching detergent compositions similar to the bleaching compositions, in which a synthetic organic detergent, preferably built by a builder salt, is present with the previously mentioned bleaching composition. Further objects include the discovery of methods of bleaching and simultaneously washing and bleaching fabrics and laundry with such compositions or the constituents thereof.

In accordance with the present invention a bleaching composition comprises a water soluble peroxymonosulfate bleach, a water soluble inorganic bromide in sufficient quantity to promote the bleaching activity of the peroxymonosulfate and an N-hydrogen compound of a particular type which inhibits destruction of dyes and overbleaching of dyed materials while stains to be bleached by the composition are effectively removed from substrates. The invention also relates to a bleaching detergent composition comprising a normally solid, water soluble synthetic organic detergent and the components of the described bleaching composition, preferably with a builder salt for the detergent also being present. With respect to the bleaching composition aspect of the invention, desirable bleaching compositions consist essentially of about 5 to 25 parts by weight of a water soluble peroxymonosulfate bleach, about 3 to 20 parts by weight of a water soluble inorganic bromide, in sufficient quantity to promote the bleaching activity of the peroxymonosulfate and about 2 to 30 parts by weight of an aromatic sulfonamide compound selected from the group consisting of benzene sulfonamide, toluene sulfonamide, ethylbenzene sulfonamide, dodecylbenzene sulfonamide and xylene sulfonamide, N-alkali metal salts of said sulfonamides, N-acetyl and N-benzoyl derivatives of said sulfonamides and of said salts of said sulfonamides and mixtures of such sulfonamides, salts and derivatives, and inhibit destruction of dyes and overbleaching of dyed materials while stains to be bleached by the compositions are effectively removed from substrates. Within the bleaching detergent composition aspect of the invention desirable such compositions consist essentially of about 5 to 50 parts by weight of normally solid, water soluble synthetic organic detergent, about 5 to 25 parts by weight of water soluble peroxymonosulfate bleach, about 3 to 20 parts by weight of water soluble inorganic bromide, in sufficient quantity to promote the bleaching activity of the peroxymonosulfate and about 2 to 30 parts by weight of an aromatic sulfonamide compound selected from the group consisting of benzene sulfonamide, toluene sulfonamide, ethylbenzene sulfonamide, dodecylbenzene sulfonamide and xylene sulfonamide, N-alkali metal salts of said sulfonamides, N-acetyl and N-benzoyl derivatives of said sulfonamides and of said salts of said sulfonamides and mixtures of such sulfonamides, salts and derivatives, and inhibit destruction of dyes and overbleaching of dyed materials while stains to be bleached by the bleaching detergent compositions are effectively removed from substrates. Methods of bleaching and simultaneously washing and bleaching fabrics with the components of such compositions are also within the invention.

In my parent application, Ser. No. 391,058, when water soluble inorganic bromide was employed to improve the bleaching effect of water soluble inorganic peroxymonosulfate bleaching agent the optical brighteners preferably used were those characterized as chlorine-stable brighteners, e.g., the triazolyl brighteners sold under the trade names Phorwite BHC-766 and Tinopal RBS, by Verona-Pharma Chemical Corporation and Ciba-Geigy Chemical Corporation, respectively. Such fluorescent brighteners are more expensive than the triazine brighteners usually employed in non-bleaching detergent compositions but the triazine brighteners are more susceptible to decomposition and loss of fluorescent effectiveness in the presence of peroxymonosulfate and bromide so the use of the more stable brighteners is often mandatory. Although it has been found that if the pH of a bleaching or bleaching detergent solution is maintained high, e.g., above 10.5, the "ordinary" fluorescent brighteners may still be sufficiently stable so as to be practicable, it has been desirable to apply them under conditions which further improve their brightening activities, even at elevated pH's and prevent decomposition at lower pH's, such as may often be encountered during bleaching and washing-bleaching operations. By means of the present invention such effects are obtained and the effectiveness of relatively low cost brighteners is much greater than can be obtained by direct use of a halogen bleach or one generated from peroxymonosulfate and sodium bromide.

It has been theorized by the present inventor that the N-hydrogen compound or a corresponding N-alkali metal compound (the term N-hydrogen compound includes N-alkali metal compounds as well as N-hydrogen compounds, as described and illustrated herein) utilized affects the liberation of hypobromide and hypobromous acid from peroxymonosulfate and bromide in an aqueous medium by forming an N-bromo derivative of the compound and that such compound formed in situ functions to control or regulate bleaching. Thus, by judicious choice of conditions including concentration and ratio of peroxymonosulfate, bromide and compound selected to provide N-bromo compound, a bleaching effect can be obtained which is sufficiently strong to be practical and yet is milder than that of sodium hypochlorite or peroxymonosulfate activated by bromide. Accordingly, the N-hydrogen compounds utilized are those which form mildly bleaching bromine derivatives in the manner described. Although the theory given explains the improved beneficial effects attendant the present invention applicant is not bound by the theory and his invention is not to be considered as being limited by it since the invention is of various compositions and corresponding bleaching and bleaching-washing processes in which the components of the compositions are employed.

The bleaching agent utilized in the present bleaching compositions and bleaching detergents and corresponding processes is a water soluble peroxymonosulfate, normally an alkali metal peroxymonosulfate, such as potassium or sodium peroxymonosulfate. Potassium peroxymonosulfate, $KHSO_5$, is available as the mixed salt $2KHSO_5.KHSO_4.K_2SO_4$, sold by E. I. DuPont DeNemours and Company, Inc. under the trademark Oxone®. That product has an active oxygen content of about 4.5%. The active oxygen content of the mixed salt described is about 5.2% when the salt is pure and the corresponding active oxygen content of $KHSO_5$ is about 10.5%. Thus, the pure mixed salt has half as much active oxygen in it as has the pure peroxymonosulfate and the 86.5% pure mixed salt (Oxone®) has 43% as much. In this specification when peroxymonosulfate is mentioned the single salt is intended, with its higher active oxygen content, but an equivalent proportion of the triple salt, such as that sold under the trademark Oxone, will normally be employed as the source of the active bleaching compound because of its ready availability, stability and desirable physical characteristics. Potassium peroxymonosulfate may also be named as potassium monopersulfate and its triple salt may also be considered to be a monopersulfate compound within this invention.

The water soluble bromide employed to promote the bleaching activity of the peroxymonosulfate bleaching agent is preferably an alkali metal bromide, such as sodium or potassium bromide. Sodium bromide, which is very effective in the present compositions and processes and which is readily available and comparatively inexpensive, is especially preferred.

The N-hydrogen compounds which inhibit destruction of coloring and fluorescent dyes and which do not allow the overbleaching of dyed materials, while stains to be bleached are effectively removed from substrates by the combination of peroxymonosulfate and bromide, may be any of a wide variety of such compounds wherein an NH or $NH_2$ group is present next to a strong electron-attracting $SO_2Ar$ grouping (Ar = aryl, preferably mononuclear), an NH group is present next to one or two carbonyl (C = O) groups or an NH group is present between $SO_2$ and C = O functional groups, and mixtures thereof. Usually the N-hydrogen compounds will contain in the range of 3 to 10 carbon atoms, preferably with 3 to 6 of these being in a heterocyclic or homocyclic ring. Of the described compounds the most preferred are the cyclic compounds, either homocyclic or heterocyclic, such as the sulfonamides and hydantoins, of which outstanding examples are the toluenesulfonamides such as para-toluenesulfonamides, and the lower alkyl substituted hydantoins, especially the 5,5-substituted hydantoins, wherein the alkyls are of 1 to 4 carbon atoms, e.g., 5,5-dimethylhydantoin. Examples of other useful N-hydrogen compounds are alkali metal toluenesulfonamides, preferably sodium and potassium para-toluenesulfonamides; orthotoluenesulfonamide; benzenesulfonamide; para-ethylbenzenesulfonamide and corresponding mono-alkali metal salts; N-acetyl and N-benzoyl mononuclear (preferably benzene and toluene) sulfonamides, such as N-acetyl-para-toluenesulfonamide, N-acetylbenzenesulfonamide, N-benzoyl-benzenesulfonamide; 5,5-diethylhydantoin; 5,methyl-5-ethylhydantoin; saccharin and glycoluril; but various other of the described classes of compounds are also useful provided that they include the described replaceable hydrogen and function like the preferred hydantoins and sulfonamides. In the selection of particular N-hydrogen compounds to be employed the controlling factor is the actual effect thereof on dyes and dyed fabrics treated with the bleaching or bleaching detergent composition. Thus, if the particular N-hydrogen compounds forms an intermediate which is not obnoxious in odor and is thermally stable and which reacts more gradually, and usually, more regularly, with the water soluble peroxymonosulfate to release active oxygen therefrom or produce another bleaching derivative which has the property of effectively bleaching without overbleaching dyed fabrics and which does not destroy fluorescent dyes used in bleaching and washing-bleaching processes and compositions, it may be employed. On the other hand if it produces an intermediate or derivative that results in rapid and uncontrolled bleaching, causing destruction of dyes of dyed materials when stains are being bleached out from such or accompanying materials or if it results in lesser substantivity or take-up of fluorescent dyes to/on fabrics being treated it will usually be rejected, at least for general household use, although there may be specific controlled processes in which it can perform effectively.

Various fluorescent brighteners, sometimes called optical brighteners or optical dyes, may be incorporated in the present bleaching and bleaching detergent compositions and processes. The more stable fluorescent brighteners, such as the chlorine-stable brighteners, which can be effective fluorescent brightening materials in the presence of hypochlorite bleach, are still effective in the presence of the controlled bleaching composition of this invention. Thus, commercial triazolyl brighteners BHC, RBS-200 and CBS, the formulas of which are given in parent application Ser. No. 391,058, the specification of which is incorporated herein by reference, are useful, but because they are expensive it is much preferred to employ ordinary brighteners of types which are usually susceptible to degradation in the presence of strong bleaches, such as chlorine bleaches. Among such materials are the triazine brighteners, 4,4'-bis-(4-anilino-6-methyl-ethanol-S-triazin-2-ylamino)-2,2'-stilbenedisulfonic acid, disodium salt (Tinopal 5BM Conc.); 4,4'-bis-(4-anilino-6-morpholine-S-triazin-2-ylamino)-2,2'-stilbenedisulfonic acid, disodium salt (Calcofluor White RC or Stilbene 4); and 4,4'-bis-(4-anilino-6-diethanol-S-triazin-2-ylamino)-2,2'-stilbenedisulfonic acid, disodium salt (Calcofluor CG or Stilbene 3). Although the described compounds are disodium salts, other salts thereof may also be employed, such as other alkali metal salts, e.g., dipotassium salts and monosodium and monopotassium salts, other triazine fluorescent dyes of similar structure, wherein at the 6-position of the triazine moiety there are present other lower alkyl lower alkanol and di-lower alkanol groups, of 1 to 4 carbon atoms each, instead of the alkanol substituents on the Tinopal 5BM Conc. and Calcofluor CG, respectively. Also, instead of morpholine, various such alkyl-substituted morpholine derivatives may be used. The stabilities of the fluorescent dye components of the present compositions in aqueous media is good over the usual pH ranges confronted, e.g., 7.0 - 11 despite the fact that the dyes and ordinary fluorescent brighteners may be adversely affected by similar compositions not containing the N-hydrogen compound, especially if the pH is about 10 or less.

In addition to the specifically mentioned fluorescent brighteners and classes thereof recited, other useful brighteners which may be utilized in the present invention and are not in the class of highly stable or chlorine stable brighteners include the the various commercial brighteners presently on the market and employed in light and heavy duty laundry detergents, which are usually of the stilbene, triazine or morpholine types preferably morpholine or triazine stilbene disulfonic acids or alkali metal salts thereof.

The bleaching compositions of this invention and the materials employed in the bleaching processes may comprise only those previously mentioned, the peroxymonosulfate, bromide and N-hydrogen compound, with or without fluorescent brightener but usually there will be present with such materials filler salts and/or builder salts and various adjuvants. Such materials will be described after recitation of the various additional components of the bleaching detergents (other than those already mentioned as being in the bleaching compositions).

The detergent compositions of the invention usually include as a primary detersive constituent a water soluble synthetic anionic detergent salt selected from the group consisting of organic sulfonates, sulfates, phosphates and phosphonates but the anionic detergent(s) can be supplemented, or if desired, replaced entirely by water soluble organic nonionic detergent(s). Such suitable detergents are described in *McCutcheon's Detergents and Emulsifiers* 1969 *Annual* (also for 1973), wherein such compounds are listed by chemical formulas and trade names. Additional suitable detergents of the aforementioned types are also described in the text *Surface Active Agents and Detergents,* Vol. II, by Schwartz, Perry and Berch (Interscience Publishers, 1958). In short, useful anionic materials include hydrophilic and lipophilic groups, the lipophilic portions of which normally contain a higher hydrocarbyl chain, usually of 10 to 20 carbon atoms and the hydrophilic portions of which include a salt-forming ion, preferably an alkali metal cation, and an acid group of the mentioned class. Among such useful detergents the organic sulfonates and sulfates are preferred (especially the former) but corresponding organic phosphonates and phosphates are also useful. Suitable anionic detergents, include, for example, linear higher alkyl benzene sulfonates; branched chain higher alkyl benzene sulfonates (these are not usually sufficiently biodegradable to be accepted in modern detergent formulations); higher olefin sulfonates; higher alkyl sulfonates; higher paraffin sulfonates; higher alcohol sulfates, including sulfated derivatives of higher polyhydric alcohols which are incompletely esterified with higher fatty acids; and the sulfates of condensates of higher alcohols and lower alkylene oxides and glycols, i.e., alkylene oxides and glycols of 2 to 4 carbon atoms such as ethylene oxide, propylene oxide, ethylene glycol, butylene glycol and the like. The higher hydrocarbyl, alkyl and higher fatty acyl groups of such compounds will generally be of 12 to 18 carbon atoms and the salt-forming cations thereof will preferably be alkali metal cations, e.g., sodium and potassium, with ammonium, amine and alkanolamine sometimes also being useful to form the desired salts. The sodium salts tend to make harder detergent products which are more freely flowing and have lesser tendency to cake, which is important because the compositions of this invention are desirably free flowing particulate materials.

Among the preferred organic sulfonate detergents, linear higher alkyl aromatic sulfonates, preferably those wherein the aromatic group is phenyl, are utilized and linear tridecyl benzene sulfonates, usually as the sodium salt, are especially preferred. Of these materials it is highly preferred to employ the linear higher alkyl benzene sulfonates wherein the alkyl substituents are of 12 to 18 carbon atoms, especially of 12 to 15 carbon atoms, and in which the salt-forming cation is alkali metal, especially sodium, e.g., sodium linear tridecyl benzene sulfonate. However, the alkali metal sulfates of lower alkoxylated, e.g., ethoxylated, higher fatty alcohols and middle ($C_{7-9}$) alkyl phenols are also useful. In such aliphatic and aromatic compounds there will usually be from 3 to 20 lower alkoxy groups present.

The nonionic detergents employed in various of the above-described preferred embodiments of the invention are usually poly-lower alkoxylated lower alkanols of lipophilic moieties, wherein the lower alkoxies and alkanols are of 2 to 3 carbon atoms, preferably 2, and the lipophiles are from higher akanols, middle alkyl (7 to 9 carbon atoms) phenols or polypropylene oxide condensates. The nonionics include higher alkyl poly-lower alkoxylates or, in other words, higher alkyl poly-lower alkoxy alcohols, i.e., the condensation products of higher fatty alcohols with lower (2–4 carbon atoms) alkylene glycols and/or with lower alkylene oxides, such as ethylene oxide or propylene oxide (mostly ethylene oxide in all such cases), as exemplified by Neodol® 45-11, Plurafac® B-26 and Alfonic® 1618-65. Such products are normally near-liquid or semi-solid at room temperature but can be "solidified" by the other components of the described compositions. Also useful are the block copolymers of propylene glycol, propylene oxide and ethylene oxide, such as those sold as Pluronics®, e.g., Pluronic F-68, and the middle alkyl phenyl polyoxyethylene ethanols, such as those sold as Igepals®. Preferably, the nonionic detergent that will be utilized in the invention is a higher linear alkyl polyethoxy ethanol. The number of carbon atoms in the higher alkyl group averages from 8 to 20, preferably from 12 to 15 and especially from 14 to 15 and the molar ratio of ethoxy groups to higher alkyl groups is usually from 3 to 20, preferably 9 to 13 and especially preferably, about 11.

The builder salts which are employed in the invention are well known in the laundry detergent art and generally exert a desirable effect in overcoming water hardness and in increasing the cleaning ability of the organic detergent. In the present products they also help to impart a desirably alkaline pH to a bleach medium or wash water, generally about 7 or 8 to 10 or 11 and advantageously about 9 to 10, e.g., about 9.5. Suitable builder salts include water soluble salts having inorganic anions, e.g., pyrophosphates, tripolyphosphates, orthophosphates, silicates, carbonates, sequicarbonates, bicarbonates, borates and the like, as well as water soluble salts having organic anions, such as tartrates, citrates, gluconates and salts of other hydroxy acids. Nitrogen-containing sequestrants and builders, such as NTA, EDTA and hydroxyethyl-iminodiacetates are sometimes avoided because of stability problems encountered or possibly harmful effects thereof on humans but may be sometimes used in suitable formulations. The cations associated with the above described inorganic and organic anions in the builder salt are preferably alkali metal cations, e.g., sodium and/or potassium. Preferable builder salts of the invention are selected from the readily available and inexpensive pyrophosphates, e.g., tetrasodium pyrophosphate; tripolyphosphates, e.g., pentasodium tripolyphosphate; citrates, e.g., sodium citrate; bicarbonates, e.g., sodium bicarbonate, potassium bicarbonate; carbonates, e.g., sodium carbonate, potassium carbonate; silicates, e.g., silicates having an $Na_2O:SiO_2$ ratio of 1 to 2.4; and trisodium nitrilotriacetate (except where nitrogen-containing materials are to be avoided), but various other builders known in the art are also useful.

The use of an inert, water soluble filler salt is desirable in both the bleaching and laundry detergent formulations and in the corresponding processes. In the mentioned products the filler salt employed should be at least substantially free of any halide anions and preferably completely free of such ions. It is highly preferable that on solution in aqueous media none of the filler salt ionizes to chloride or bromide anions because in the presence of peroxymonosulfate salt bleaching agent chloride anion may be oxidized to elemental chlorine, which is undesirable and bromide anion from the filler salt might well make the content of bromide, together with that from the promoter bromide salt, sufficient to overpromote the peroxymonosulfate bleach, possibly producing deleterious effects on the optical brightener constituents and/or on dyed fabrics being treated. A preferred halide-free filler salt is an alkali metal sulfate, e.g., sodium or potassium sulfate. Sodium sulfate is especially good and is usually present in the product in anhydrous form or only to a minor extent, e.g., less than 10% thereof, as a hydrate.

Both the inorganic filler and builder salts help to make the present compositions free flowing particulate materials but the filler (sodium sulfate, anhydrous) is especially desirable in the products when the builder salt includes a major proportion of sodium silicate or NTA, both of which may be less free flowing and moisture sorptive (without caking) than polyphosphates and carbonates. The alkali metal silicates exert desirable alkalinizing effects, inhibit corrosion, help to counteract water hardness and have independent detersive effects and the property of improving the detersive actions of the anionic and nonionic detergents and combinations thereof. The alkali metal silicates which are preferred constituents of the detergent and bleach compositions are of the formula $M_2O:SiO_2$, wherein M represents alkali metal, e.g., sodium or potassium, most preferably sodium, and the ratio of $M_2O:SiO_2$ is in the range of 1:1 to 1:3, preferably 1:2 to 1:2.5, especially about 1:2.4.

Together with the foregoing components of the present bleaching and bleaching detergent compositions there may be present additional minor adjuvants which impart certain functional or esthetic properties to the products. In general, these include perfumes; water soluble dyes; water dispersible pigments; long chain fatty acid soaps, i.e., alkali metal salts of $C_{10}$ to $C_{18}$ alkanoic and alkenoic acids, such as tallow and coconut oil fatty acids, the former types being especially useful as anitfoaming agents and detergents; organic gum antiredeposition agents, such as the alkali metal carboxymethyl cellulose salts, especially sodium carboxymethyl cellulose, polyvinyl alcohol, polyvinyl pyrrolidone and polyacrylamide; foam improvers, such as lauric myristic diethanolamide; foam destroyers, such as silicones; fungicides, such as the polyhalosalicylanilides; flow improving agents, such as the clay product commercially sold under the trade name "Satintone"; and an odor stabilizer or malodor-inhibitor, such as Iphol. Iphol is a mixture of 2-methyl-4-isopropyl phenol and 2-methyl-6-isopropyl phenol and is the product of the reaction of orthocresol with isopropanol in the presence of phosphoric acid. Of course, the various adjuvant materials will be selected for the properties desired in the finished products and to be compatible with the other constituents thereof, which means that some of them may be suitable for use only with one or the other of the bleach and bleaching detergent compositions.

The "equivalent" proportions of active oxygen derived from peroxymonosulfate ($KHSO_5$), water soluble inorganic bromide and N-hydrogen compound will usually be in the range of about 0.5–2:0.05–2:0.1–2 and preferably are about 1:1:0.3–0.7, with the more preferred proportions of N-hydrogen compound often being about 0.5. On a weight basis, in which allowances will sometimes be made due to different molecular weights of the N-hydrogen compounds especially (an average molecular weight being about 150), the proportions are about 5–25:3–20:2–30, respectively, preferably 10–20:5–15:5–15 ($KHSO_5$:bromide:N-hydrogen compound). It will be evident that when a commercial material such as Oxone is employed as a source of peroxymonosulfate the proportion thereof required to provide the desired amount of active oxygen will be greater than that indicated above, due to the fact that Oxone is only about 43% as effective as pure peroxymonosulfate. When fluorescent brightener is present in the bleaching composition the proportion thereof by weight will usually be in the range of 0.5 to 10, preferably 0.5 to 2, with the other proportions of components previously given. Thus, a typical preferred bleaching composition with fluorescent brightener may be of relative proportions of about 15:8:7:1.5 and such proportions will be about 15:8:7, without the brightener content.

For the bleach compositions described, the proportions given may be considered as part or percentages in final products, with the balance of such a product usually comprising inert filler salt, builder salt and adjuvants. The adjuvant content will usually not exceed 20% of the product, preferably is less than 10% thereof and more preferably is less than 5%. The balance of the bleach composition may be a mixture of filler salt and builder salt or all of one or the other type. However, the ratios of such materials will normally be from 5–85, preferably 20–65 of filler salt and 0–60, preferably 10 to 50 of builder salt. Thus, a typical bleaching composition may include 10 or 15 parts (or percent) of peroxymonosulfate, 8 parts of water soluble inorganic bromide, 7 parts of N-hydrogen compound, 1.5 parts of fluorescent brightener (which may sometimes be omitted), 5 parts of adjuvant(s), 48.5 or 53.5 parts of builder salt (because it is desirable to have it contribute its alkalinity to make the bleach or wash water pH about 9 or more, e.g., 9–10.5) and 10 to 15 parts of filler salt (or 25 parts of the builder salt may be replaced by filler salt). In the above formulas when Oxone or similar multiple salt is employed as a source of peroxymonosulfate the "inactive" balance of the salt $K_2SO_4$ and $KHSO_4$, is considered to be part of the filler salt content of the product (note the correspondence in amounts of peroxymonosulfate and filler above).

The bleaching detergent compositions of this invention include about 5 to 50 parts, preferably 10 to 25 parts of synthetic organic detergent and 10 to 100 parts, preferably 20 to 50 parts of builder salt. The parts or percentages of inorganic filler salt will be about the same as those of the builder salt and of course, in some cases, where a lighter duty bleaching detergent is being manufactured, the builder salt may be omitted. When nonionic detergent is present it will preferably be limited to about 10% of the composition, more preferably to about 4% and most preferably to about 2% thereof, especially if it is of liquid, pasty or soft waxy characteristics. Similarly, the sodium silicate content of the final products should be limited to about 25%, preferably being less than 15%. A typical bleaching detergent composition of this invention contains about 5 to 25% of peroxymonosulfate bleach, 3 to 10% of bromide, 2 to 15% of N-hydrogen compound, 5 to 30% of anionic detergent, 0.0 to 10% of nonionic detergent, 10 to 60% of builder salt, 10 to 60% of filler salt, 0.1 to 2% of fluorescent brightener and less than 5% of adjuvants. Preferably, such composition will contain from 5 to 15% of potassium peroxymonosulfate, 3 to 8% of sodium bromide, 2 to 7% of para-toluenesulfonamide or 5,5-dimethylhydantoin, 5 to 15% of sodium linear higher alkylbenzene sulfonate in which the higher alkyl is of 12 to 15 carbon atoms, 0.0 or 0.5% to 2% of higher fatty alcohol-polyethylene oxide condensate, the higher fatty alcohol of which is of 12 to 15 carbon atoms and the ethylene oxide portion of which is a chain 7 to 20 ethylene oxide units long, 15 to 40% of sodium sulfate (mostly) filler (including about 5 to 15% of potassium sulfate and potassium bisulfate from the multiple salt containing the potassium peroxymonosulfate), 15 to 30% of pentasodium tripolyphosphate, 3 to 10% of sodium silicate of $Na_2O:SiO_2$ ratio of about 1:2.4, 0.1 to 2%, preferably 0.5 to 1.5% of one or more of the preferred Tinopal 5BM Conc., Stilbene 3 and Stilbene 4 brighteners and about 0.1 to 1 or 2% of adjuvants. The builder may also include borax, $Na_2CO_3$ and molecular sieves, with the former normally being from 0.5 to 10% of the product and the others being from 5 to 30% thereof, when present, with each being a replacement of about equal parts of other builder and filler salts. Of course, if lesser or greater extents of bleaching are desired the contents of the three bleaching components, the peroxymonosulfate, bromide and N-hydrogen compound may be diminished or increased about 50% but normally the proportions and percentages will be in the ranges previously given.

The compositions of this invention may be advantageously prepared by mere mixing of the various powdered components and spraying onto the surfaces of the tumbling mixture any liquid ingredients. However, it is preferred to spray dry the major proportion of the mixture including the bromide and, when sufficiently stable (usually less than 20% decomposition), the N-hydrogen compound, into characteristic globular particles, to which perfume, peroxymonosulfate salt or a source thereof, such as Oxone, and N-hydrogen compound, if not heat stable, may subsequently be added. Conveniently, before drying, agitation is accomplished in a conventional soap crutcher over a suitable time period, e.g., three minutes to one hour, at a temperature ranging from room temperature or a moderately elevated temperature to about 80° or 90° C. The aqueous mixture is then converted to a particulate solid by spray drying. According to a normally employed spray drying technique the aqueous mixture is forced through restricted orifices, for example of cross-sectional area equivalent to a circular passage of 1 to 5 mm. in diameter, at a high pressure, e.g., 200 to 1,000 lbs./sq. in., so as to result in production of a spray of aqueous droplets. The droplets are allowed to fall through a spray drying tower, wherein they are contacted with a countercurrent or concurrent flow of hot drying air. The drying air entering the spray drying tower will be of an initial temperature in the range of about 200° to 500° C. The drying operation will be controlled, as by regulation of drying gas temperatures and tower throughput rates, to make detergent particles of a desired moisture content, generally in the range of about 2 to 10%, preferably 4 to 10%, e.g., 4 to 6%. It is then preferred for the spray dried particles to be screened and sized to obtain product particles in about the 6 to 140 mesh range (U.S. Standard Sieve Series). Preferably, the product will pass completely through a No. 8 screen and no more than 10% will pass through a No. 100 screen. Also preferably, it will have a cup weight of between 50 and 150 grams, more preferably about 75 grams, weights which correspond to bulk densities of 0.21 to 0.63 g./ml., preferably 0.32 g./ml. Subsequently, if desired, perfume may be added by spraying onto the detergent and a desiccant material, such as sodium sulfate or magnesium sulfate, may also be admixed with it. Any other adjuvants which are sensitive to elevated temperature, particularly in aqueous media, or part or all of any constituent of the composition, for example, the N-hydrogen compound, may be added after the spray drying step if it is considered to be advantageous to do so with respect to the particular formulation. The particulate product is then charged to a tumbling drum for admixing with the peroxymonosulfate salt, whose particle size will preferably approximate that of the base detergent to which it is being added. Flow-improving clay, e.g., Satintone ®, may also be added.

The procedure followed for the manufacture of the present products is the same for both bleaching compositions and bleaching detergents but in some cases it is preferable merely to blend together previously size-reduced powders, preferably of the sizes given but which may also be between 8 and 200 mesh, to make the bleaching composition. Variations in the procedure may also be employed wherein the peroxymonosulfate and/or the bromide is/are encapsulated or otherwise stabilized to prevent premature reactions.

The bleaching compositions and the components of them may be used in normal manner for the bleaching of stains from white and colored goods in the presence or absence of ordinary fluoresent brighteners. Normally the materials treated are fabrics or articles made from fabrics, some of which have been stained with organic soils and/or food stains, e.g., wine, coffee, tea, chocolate, ice cream, grape juice, clay, carbon. The fabrics are usually of cotton, polyester or cotton-polyester blends, with the blends having a proportion of cotton in the range of 10 to 90%, preferably 35 to 70%. However, the compositions may also be used to treat other fabrics, such as nylon, wool and rayon, to mention only a few. The bleaching composition may also be employed to bleach stains from various other substrates, as from walls, floors, tiles, linoleums, painted surfaces, etc. It may also be employed as an antibacterial or sterilizing agent. The bleaching detergent compositions may be utilized similarly or in a combination of washing and bleaching processes and may be employed to wash and bleach stained fabrics or other surfaces, such as those mentioned. In the bleaching method the various components of the bleaches previously described are usually employed at a total concentration of such materials in aqueous medium (water) which is about 0.01 to 2%, normally from 0.05 to 1%. The temperature of the aqueous medium will be about 10° to 70° C., preferably 40° to 60° C. and the time of bleaching will be from 5 minutes to 3 hours, preferably from 5 minutes to 30 minutes or one hour. The weight proportion of fabrics treated to aqueous medium will usually be about 1 to 30%, preferably from 5 to 20%. For washing and bleaching at the same time the described composition or the components thereof are usually employed at a concentration of about 0.02 to 1%, preferably about 0.1 to 0.2% in American practice and about 0.4 to about 1% in European practice. The temperatures and times for treatment are about the same as previously mentioned for bleaching as will be the weight of material being washed and bleached per weight of aqueous medium. The pH of the wash water will normally be in the range of 7 or 7.5 to 11, preferably 8 to 10 and most preferably about 9 or 9.5 to 10 and similar pH's will be used for bleaching, although for such they may be diminished by one pH unit, while not being less than 7. In a preferred embodiment of the invention the aqueous wash medium comprises from 0.01 to 0.05% of sodium linear higher alkylbenzene sulfonate, the higher alkyl of which is of 12 to 15 carbon atoms, 0.002 to 0.01% of higher fatty alcohol - polyethylene oxide condensate, the higher fatty alcohol of which is of 12 to 15 carbon atoms and the ethylene oxide portion of which is a chain 7 to 20 ethylene oxide units long, 0.002 to 0.02% of potassium peroxymonosulfate, 0.002 to 0.01% of sodium bromide, 0.004 to 0.02% of N-hydrogen compound which is either para-toluene sulfonamide or 5,5-dimethylhydantoin, 0.02 to 0.1% or 0.2% of a mixture of sodium carbonate, sodium tripolyphosphate and sodium silicate builder salts and 0.0005 to 0.003% of 4,4'-bis(4-anilino-6-methyl-ethanol-S-triazin-2-ylamino)-2,2'-stilbenedisulfonic acid, disodium salt. Such concentrations may be increased proportionately for European practice.

The following examples illustrate but do not limit the invention. Unless otherwise indicated all parts are by weight and all temperatures are in ° C.

EXAMPLE 1

The following six solutions, A-F, are made, using tap water.

| Component | Solution A | B | C | D | E | F |
|---|---|---|---|---|---|---|
| Oxone ($2KHSO_5.KHSO_4.K_2SO_4$, of active oxygen content of 4.5%), grams | 0.75 | 0.75 | 0.75 | 0.75 | 0.75 | 0.75 |
| Sodium bromide, grams | — | 0.2 | 0.2 | 0.2 | 0.2 | 0.2 |
| TSA (p-toluene sulfonamide), grams | — | — | 0.04 | 0.1 | — | — |
| DMH (5,5-dimethyl-hydantoin), grams | — | — | — | — | 0.05 | 0.13 |
| Sodium carbonate, grams | 0.75 | 0.75 | 0.75 | 0.75 | 0.75 | 0.75 |
| Water, kilograms | 1 | 1 | 1 | 1 | 1 | 1 |

The various preparations, A-F, each containing about 33 parts per million (p.p.m.) of active oxygen from the Oxone, are used to bleach a mixture of stained, non-stained and colored test cloths throughout a 15 minute period of agitation in a laboratory washing machine (Terg-o-Tometer) at 49° C. The carbonate is present to maintain the pH at about 9.7 throughout the treatment. The bleaching load in the washing machine consists of two swatches each (8 × 10 cm. squares) of cotton test cloths of types described in Table I. Reflectance changes ($\Delta Rd$ and $\Delta b$) are calculated from reflectance readings taken on dry cloth swatches, using a Gardner Color Meter before and after completion of the operations. Stain removal efficacy is determined by an increase in reflectance ($\Delta Rd$) and safety to color is indicated by small, if any, changes in the $Rd$ and $b$ values, compared to control A. Retention of whiteness is indicated by no change in $Rd$ and $b$ values of clean white fabric. A positive ΔR*d*, combined with a negative change in the *b* reading, indicates that the fabric is less yellow (whiter) after washing. Test results are given in Table I. Test cloths employed are cotton except for the blue dyed swatches, which are of a 65:35 ratio of polyester and cotton, and the total swatch weight is about 25 grams.

TABLE I

| Test Cloths and Reflectance Characteristics | Reflectances After Treatments with Solutions A–F | | | | | |
|---|---|---|---|---|---|---|
| Types | A | B | C | D | E | F |
| Coffee/Tea Stain (ΔRd) | 5.4 | 10.1 | 10.0 | 9.1 | 10.1 | 9.8 |
| Red Wine Stain (ΔRd) | 15.5 | 36.1 | 36.3 | 30.3 | 36.6 | 35.5 |
| Sulfo Dye Stain (ΔRd) | 3.1 | 45.6 | 40.7 | 15.3 | 39.1 | 30.5 |
| Calcoloid Blue Dyed (ΔRd) | 1.1 | 3.9 | 3.1 | 1.4 | 2.8 | 1.8 |
| Calcoloid Blue Dyed (Δb) | −0.2 | 3.1 | 2.1 | 0.2 | 1.4 | 1.0 |
| Non-Stained White (ΔRd) | −0.2 | 0.4 | 0.2 | −0.2 | 0.2 | 0.0 |
| Non-Stained White (Δb) | −0.2 | −0.5 | −0.5 | −0.3 | −0.4 | −0.4 |

From the results it will be apparent that the addition of the bromide to Oxone results in improved stain removal and whiteness but adversely affects the color of the dyed test fabric. By further addition of TSA or DMH stain removal is diminished slightly but objectionable color changes of the dyed materials are also decreased. The non-stained white material is of essentially the same whiteness with the N-hydrogen compounds present with the Oxone and sodium bromide as it is with the Oxone and sodium bromide alone. The various data are confirmed by visual observation, too.

For convenience of use the above formulations of powdered components are mixed together before dissolving in the water. However, they may be added sequentially to the water or the bromide and N-hydrogen compound may be spray dried together and mixed with the Oxone powder and carbonate, with the mixture being subsequently added to the wash water, and in such cases the same results are also obtained.

When the proportions of the Oxone, sodium bromide and N-hydrogen compound of the above experiment are changed, so as to be at various points within the range described in the specification, with the active oxygen from the Oxone, bromide and N-hydrogen compound being within the range of 0.5 – 2 : 0.5 – 2 : 0.1 – 2 and preferably 1 : 1 : 0.3 – 0.7, similar improvements in bleaching power with little harm to dyed fabrics are obtained. This is also the case when, for formulations within such ranges, the described N-hydrogen compounds are replaced by similar materials, such as orthotoluene sulfonamide, ethylhydantoin, 5-phenyl hydantoin, benzene sulfonamide and xylene sulfonamide. Similarly, saccharin, p-carboxybenzene sulfonamide, dodecylbenzene sulfonamide and aromatic sulfonamides corresponding to the sulfonchloramides of my U.S. Pat. No. 2,809,937, hereby incorporated by reference, phthalimide and its potassium salt and cyanuric acid and its alkali metal salts (mono, di and tri-substituted, preferably sodium salts) may replace the mentioned N-hydrogen compounds and good bleach moderating effects will be obtained, as with TSA and DMH. This is also the case when sodium carbonate is omitted and when it is replaced entirely by other builders, such as pentasodium tripolyphosphate, sodium tetrapyrophosphate and sodium silicate ($Na_2O:SiO_2 = 1:2.4$) or when it is half replaced by such builders and half by sodium sulfate, as a filler. Thus, the invented bleach is effective, yet mild, at pH's of 7 to 11, preferably 9 to 10.

EXAMPLE 2

The procedures of Example 1 are repeated except for the addition to the water, prior to the bleach, of 1.5 g. (per liter) of a commercial heavy duty built synthetic detergent composition. Such detergent is a spray dried product containing 15% of sodium linear tridecylbenzene sulfonate, 32% of phosphate solids (from pentasodium tripolyphosphate), 31.8% of sodium sulfate, 7% of sodium silicate ($Na_2O:SiO_2 = 1:2.35$), 1% of polyethoxylated alcohol ($C_{14-15}$ fatty alcohol mix and 11 mols of ethylene oxide per mol of alcohol), 1% of borax (as $Na_2B_4O_7 \cdot 10H_2O$), 0.01% of Iphol preservative, 0.3% of sodium carboxymethyl cellulose, 0.2% of perfume, 0.05% of Tinopal RBS 200, 0.55% of Stilbene No. 4, 0.1% of Tinopal 5BM Conc. and 11% of water. The pH of a 1% solution of the detergent is about 10. The bleaching detergents A-F correspond to solutions A-F of Example 1 and Table I and additionally in detergent solution (run G) no bleach is employed in the laboratory washing machine. Table II gives the test results.

TABLE II

| Test Cloths and Reflectance Characteristics | Reflectances After Treatments with Solutions A–G | | | | | | |
|---|---|---|---|---|---|---|---|
| Types | A | B | C | D | E | F | G |
| Coffee/Tea Stain (ΔRd) | 4.6 | 10.4 | 9.8 | 8.9 | 9.9 | 9.3 | 1.1 |
| Red Wine Stain (ΔRd) | 16.0 | 36.5 | 36.4 | 29.7 | 37.2 | 34.3 | 7.3 |
| Sulfo Dye Stain (ΔRd) | 1.7 | 42.0 | 36.8 | 14.9 | 34.2 | 25.1 | 0.8 |
| Calcoloid Blue Dyed (ΔRd) | 1.2 | 4.0 | 3.2 | 1.6 | 2.7 | 2.1 | 1.2 |
| Calcoloid Blue Dyed (ΔRd) | −0.6 | 2.5 | 2.1 | 0.2 | 1.2 | 0.7 | −0.2 |
| Non-Stained White (ΔRd) | 0.0 | 0.7 | 0.8 | 0.4 | 0.4 | 0.7 | −0.6 |
| Non-Stained White) (Δb) | −0.6 | −0.8 | −0.7 | −0.7 | −0.7 | −0.8 | −0.4 |
| Brightener Fluorescent Intensity | 348 | 171 | 246 | 333 | 249 | 294 | 345 |

Stain removal and safety of the products to the colors of dyed fabrics are similar to those obtained in Example 1. Additionally, the presence of the detergent containing brighteners results in less apparent yellowing of the white fabric. However, strong bleaching, accompanied by good optical whiteness, is not obtained with only Oxone and bromide. The N-hydrogen compound (TSA or DMH or equivalent) also has to be present for such desirable result. Thus, fluorescent dyes or optical brighteners, as well as dyes employed to visually color fabric, are more compatible with an Oxone-bromide bleach or other monopersulfate-bromide bleach when the N-hydrogen compound is present. Results reported in Table II are also obtained when the bleaching detergent is a particulate solid composition most of which is spray dried, with the Oxone and carbonate being post-added. Sodium peroxymonosulfate compositions yield similar results.

Examples 1 and 2 illustrate the greatly improved bleaching and brightening effects obtainable in bleaches and bleaching detergent compositions when an Oxone-bromide bleach of the present invention is utilized, with N-hydrogen compound being present. It is important that the N-hydrogen compounds utilized be those described herein because other such compounds, such as urea, melamine, acetamide and sulfamide, mentioned as useful in similar bleaching compositions to maintain fiber strengths (see German Offenlegungsschrift No. 2,525,878) may be unacceptable for applicant's purposes, sometimes giving rise to release of ammonia, generation of obnoxious odors, production of explosive mixtures and instability on storage, while not sufficiently improving color stability while bleaching well. Yet, it is considered that the present compositions improve fiber strengths, compared to controls containing no N-hydrogen compound of the type described, in view of their milder oxidizing actions.

EXAMPLE 3

A moderately bleaching detergent is made of the following formula:

| Component | Parts by Weight |
|---|---|
| Commercial detergent (described in Example 2) | 150 |
| Oxone | 30 |
| Sodium bromide | 8 |
| TSA | 4 |
| Sodium carbonate | 30 |
| Sodium sulfate | 28 |

2.5 Grams of the bleaching detergent are dissolved in one liter of 49° C. tap water contained in a Terg-o-Tometer. For a comparison a commercial bleach, marketed under the trade name Clorox-2, containing sodium perborate (35%), sodium carbonate, nonionic surface active agent, fabric brighteners and perfume is employed. 1.45 Grams of such preparation are added to 1.5 grams of the commercial detergent previously mentioned and 2.95 grams of such mixture are dissolved in one liter of wash water in another Terg-o-Tometer bucket.

To each such solution in the Terg-o-Tometers are added identical loads of stained, nonstained and blue dyed test fabrics, of the types previously described in Examples 1 and 2, which are agitated in the Terg-o-Tometers for fifteen minutes with Terg-o-Tometer settings at 100 r.p.m. and 49° C. After the test fabrics are rinsed and dried they are evaluated with the aid of the Gardner Color Meter.

Although the theoretical active oxygen content of the solution of the Oxone composition is only about 13 p.p.m. in the wash water vs. about 50 p.p.m. for the Clorox-2 composition, results tabulated in Table III below show that the experimental composition removes stains better than the "control" without adverse effects on the brightener, on the color of dyed fabrics or on whiteness retention. Essentially the same results are obtained when the carbonate is replaced by a source of equivalent alkalinity, such as STPP, when another anionic detergent, e.g., sodium higher paraffin sulfonate is used and when $KHSO_5$ is the source of active oxygen, with the proportion thereof used being decreased accordingly to half.

TABLE III

| Test Cloths, Reflectance Characteristics Types and % Stain Removal | Experimental | Control |
|---|---|---|
| Coffee/Tea Stain on Cotton | | |
| ΔRd | 5.9 | 1.9 |
| % Stain Removal | 49 | 16 |
| Red Wine Stain on Cotton | | |

TABLE III-continued

| Test Cloths, Reflectance Characteristics Types and % Stain Removal | Experimental | Control |
|---|---|---|
| ΔRd | 17.9 | 11.1 |
| % Stain Removal | 42 | 26 |
| Sulfo Dye Stain on Cotton | | |
| ΔRd | 3.0 | 1.8 |
| % Stain Removal | 5 | 3 |
| Non-Stained White Cotton | | |
| ΔRd | 0.1 | −0.5 |
| Brightener Intensity Units | 357 | 363 |
| Calcoloid Blue Dyed Polyester/Cotton | | |
| ΔRd | 0.9 | 1.1 |
| Δb | −0.4 | −0.5 |

EXAMPLE 4

Fabric dyed with a highly color fugitive dye (Sirius Blue) and white cotton fabric (two 8 × 10 cm. swatches of each) are washed together in (A) the commercial detergent of Example 3 at a concentration of 1.5 g./l.; (B) the control composition of Example 3 at the concentration indicated therein; (C) the experimental composition of Example 3 at the concentration indicated therein; (D) the experimental composition of Example 3, except TSA omitted, at 2.46 g./l. and (E) the experimental composition of Example 3, except TSA and bromide omitted, at a concentration of 2.38 g./l. Washing is in a laboratory Terg-o-Tometer for 15 minutes at 100 r.p.m. and the temperature of the wash water is 49° C.

In Compositions (A), (B) and (E) the dyed fabric is essentially unchanged in color but the white fabric becomes intensely blue due to dye transfer. In Composition (D) the color of the dyed fabric is severely damaged but whiteness retention of the white fabric is excellent. In Composition C the color of the dyed fabric is about the same as with Compositions (A), (B) and (E) and whiteness retention of the white fabric is much better. Thus, the N-hydrogen compound, TSA, overcomes the dye transfer and color damage problems associated with the use of highly fugitive and bleach sensitive dyed fabrics. Apparently a bleach system is formed in situ, presumably including the N-bromo derivative of the N-hydrogen compound, which is a stronger bleaching agent than perborate but is safer to the color of the dyed fabric and to the brightener in detergent compositions than is the hypobromite bleach normally generated by the reaction of Oxone and sodium bromide.

Similar results are obtained with DMH and other of the previously named N-hydrogen compounds being used instead of TSA but TSA and DMH are generally more effective.

EXAMPLE 5

A strong bleaching detergent within the present invention is made by blending together 1.5 grams of the commercial spray dried heavy duty laundry detergent of Example 2 and 0.75 g. Oxone, 0.2 g. NaBr, 0.1 g. TSA, 0.75 g. $Na_2CO_3$ and 0.7 g. $Na_2SO_4$. This is tested for stain removal, whiteness retention, safety to fluorescent brighteners and safety to colors in comparison with a commercial dry bleach (based on sodium perborate) and a commercial liquid bleach (based on sodium hypochlorite), each of which is used with the mentioned detergent. The dry bleach is that described in Example 3 (Clorox-2) and 2.9 g. thereof are used with 1.5 g. of the commercial detergent mentioned. The liquid bleach is liquid Clorox containing 5.25% of sodium hypochlorite and 4 g. of the liquid are utilized with 1.5 g. of the commercial heavy duty detergent. Thus, the active oxygen contents of the experimental bleaching detergent compositions, the dry bleach with detergent and the liquid bleach with detergent are 33 p.p.m., 100 p.p.m. and 45 p.p.m., respectively. For convenience the compositions or mixes are identified by the letters A, B, and C, respectively.

Four grams of Composition A (including the commercial detergent), 4.4 g. of Composition B and 5.5 g. of "Composition" C (really added sequentially), are each dissolved in separate liters of Piscataway, N.J. tap water at 120° F. in Terg-o-Tometers. The Terg-o-Tometer speeds are set at 100 r.p.m. and the water temperature is 49° C. To each solution is added the same test fabric load as described in Example 3 and the washing procedure is conducted under the same conditions. Table IV records the test results. From these it is seen that experimental bleaching detergent Composition A more closely resembles chlorine bleaching detergent "Composition" C than it does oxygen bleaching detergent Composition B in stain removal and whiteness retention but in safety to the colors of dyed fabrics and in safety to detergent brightener efficacy it is more like oxygen bleaching composition B than like the mixture of liquid chlorine bleach and detergent ("Composition" C). Because the experimental product is safer to the colors of dyed fabrics and to the fluorescent brightener in the detergent than is the liquid chlorine bleach-detergent mix the visual appearance of washed and bleached white fabric is noticeably better for the experimental product than for that containing liquid chlorine bleach, due in part to the greater effect of the brightener in the experimental treatment (because it is not as badly affected by the experimental product as by the chlorine bleach).

TABLE IV

| Test Cloth Reflectance Characteristics Types and % Stain Removal | A | B | C |
|---|---|---|---|
| Coffee/Tea Stain on Cotton | | | |
| ΔRd | 9.2 | 3.8 | 9.6 |
| % Stain Removal | 76 | 32 | 80 |
| Red Wine Stain on Cotton | | | |
| ΔRd | 32.8 | 12.6 | 39.3 |
| % Stain Removal | 78 | 30 | 93 |
| Sulfo Dye Stain on Cotton | | | |
| ΔRd | 20.0 | 2.2 | 48.2 |
| % Stain Removal | 32 | 4 | 77 |
| Non-Stain White Cotton | | | |
| ΔRd | 0.5 | −0.7 | 0.8 |
| Brightener Intensity Units | 336 | 366 | 198 |
| Calcoloid Blue Dyed Polyester/Cotton | | | |
| ΔRd | 2.0 | 0.8 | 4.7 |
| Δb | 0.3 | −1.0 | 3.6 |

EXAMPLE 6

The effects of experimental bleaching detergent compositions made according to the present invention on the fluorescent intensity of a detergent brightener contained therein are compared to such effects with detergent composition alone (control), detergent composition plus hypochlorite bleach and detergent composition plus Oxone plus sodium bromide plus builder and filler (no N-hydrogen compound). 1.5 g./l. Of commercial heavy duty laundry detergent of the type described in Example 2 are employed (A) and the other comparatives are 1.5 g./l. of such commercial detergent plus enough commercial sodium hypochlorite bleach (Clorox) to produce a solution containing 45 p.p.m. active oxygen from the hypochlorite bleach (B) and 1.5 g./l. of such commercial detergent plus 2.5 g./l. of a mixture of 30% Oxone, 8% NaBr, 30% $Na_2CO_3$ and 32% $Na_2SO_4$ (C). Experimental preparations D and E contain, respectively, 4% and 7% of TSA in place of equal percentages of the $Na_2SO_4$ of C. Thus, the hypochlorite bleach preparation contains 45 p.p.m. of active oxygen from the hypochlorite whereas the Oxone preparations (C-E) contain 33 p.p.m. active oxygen from the Oxone.

To the various solutions in wash waters at 49° C. in Terg-o-Tometers set at 100 r.p.m. are added the detergent and bleaching compositions, after which there are added to each of the Terg-o-Tometers two swatches (8 cm. × 10 cm.) of white cotton fabric containing no brightener and two swatches of a retail dyed fabric on which there is a warning to avoid bleaching. After a 15 minute "wash" the test cloths are rinsed and dried. Reflectances and fluorescent intensities are read before and after the washings and are recorded in Table V below. The magnitude of the positive difference in reflectance (ΔRd) is indicative of damage to the dyed fabric and the magnitude of the fluorescent intensity of the white cotton fabric is indicative of brightener effectiveness.

TABLE V

| Test Cloths, Colors and Reflectance Characteristics Types | A | B | C | D | E |
|---|---|---|---|---|---|
| Pink (ΔRd) | −1.1 | 5.8 | 14.1 | 4.8 | −1.2 |
| White (F.I.) | 363 | 117 | 96 | 282 | 357 |
| Red (ΔRd) | −0.4 | 0.1 | 0.8 | 0.2 | −0.5 |
| White (F.I.) | 345 | 198 | 99 | 264 | 336 |
| Blue (ΔRd) | 0.9 | 2.6 | 2.5 | 2.0 | 1.2 |
| White (F.I.) | 372 | 162 | 120 | 294 | 360 |
| Maroon (ΔRd) | 0.2 | 0.2 | 0.2 | 0.2 | — |
| White (F.I.) | 360 | 192 | 72 | 273 | — |
| Brown (ΔRd) | 0.2 | 0.2 | 0.2 | 0.2 | — |
| White (F.I.) | 360 | 192 | 96 | 279 | — |

It is apparent from the test results that the pink and blue dyed fabrics faded noticeably when subjected to hypochlorite or Oxone-bromide treatments (without described N-hydrogen compound present) and that fluorescent intensity was markedly lower after such treatments than after treatments with a control. However, when an N-hydrogen compound of this invention is present fluorescent intensity is noticeably increased.

Essentially the same types of results are obtained when the detergent is omitted from these compositions, with the fluorescent brightener content thereof being present with the bleach instead.

EXAMPLE 7

Matched loads of stained and soiled white and colored fabrics are washed for 15 minutes each in General Electric Co. automatic home laundry washing machines (top loading design) with the following compositions present in about 67 liters of wash water (tap water containing about 100 p.p.m. of mixed calcium and magnesium hardness, as $CaCO_3$) at 49° C., in each case.

In Experiment A 105 grams of the commercial heavy duty laundry detergent of Example 2 are employed whereas in Experiments B and C there are utilized, respectively, 105 grams of a commercial perborate bleach (Clorox-2), containing 35% of sodium perborate, and 203 grams of such product, in each case with 105 grams of the mentioned commercial detergent product.

In Experiment D the 105 grams of the detergent are employed with 70 grams of an Oxone bleach composition according to the present invention comprising 30% of Oxone, 8% of sodium bromide, 4% of p-toluenesulfonamide, 30% of sodium carbonate and 28% of sodium sulfate.

Under the home laundry machine wash conditions described the theoretical concentration of active oxygen for the experiments are A (0); B (50); C (100); and D (13.3). Table VI gives data showing the percentages of stain removal resulting, as calculated from Gardner Color Meter measurements before and after the washing and washing-bleaching treatments.

TABLE VI

| Stains | Fabrics | Stain Removal (%) A | B | C | D |
|---|---|---|---|---|---|
| Coffee/Tea | Cotton | −10 | 33 | 44 | 72 |
| Red Wine | Cotton | 33 | 36 | 43 | 66 |
| Sulfo Dye | Cotton | 2 | 4 | 7 | 12 |
| Blood, Milk, Ink Mixture | Cotton | 38 | 8 | 7 | 12 |
| Tea | Cotton | 4 | 44 | 58 | 82 |
| Coffee | Cotton | 19 | 52 | 64 | 73 |
| Blueberry | Cotton | 30 | 60 | 70 | 84 |
| Cocoa | Cotton | 23 | 22 | 22 | 32 |
| Grape | Cotton | 39 | 66 | 72 | 85 |
| Tea | Polyester/Cotton | −4 | 33 | 50 | 67 |
| Coffee | Polyester/Cotton | 43 | 60 | 62 | 70 |
| Blueberry | Polyester/Cotton | 13 | 26 | 33 | 50 |
| Cocoa | Polyester/Cotton | 4 | −10 | −1 | 12 |
| Grape | Polyester/Cotton | 18 | 38 | 44 | 57 |

At the ends ot the various washing and washing-bleaching treatments the pH's are: A (9.3); B (10.3); C (10.5); and D (9.7).

The practical automatic washing machine comparisons of Oxone-bromide-TSA bleaching detergent compositions vs. commercial perborate bleaches at different concentrations and vs. a control detergent composition show that stain removal for the experimental system is superior to that for the commercial bleaching system, even when the commercial bleaching system includes a much greater content of active oxygen from the active bleaching component thereof. Little if any differences between the systems in overall cleaning effects, safety to colored fabrics and brightener effectiveness are apparent but stain removal is far superior for the experimental product.

EXAMPLE 8

The procedure of Example 7 is repeated but with strong bleaching systems in place of the more moderately bleaching systems of the previous example. The same detergent composition is utilized and the same washing conditions are employed. Thus, in Experiment A, to 105 grams of the commercial detergent composition of Example 7 there is added one cup (232 milliliters) of commercial sodium hypochlorite solution (5.3% NaOCl). Experiment B utilizes 105 grams of the commercial detergent plus 95 grams of an Oxone bleach consisting of 55% of Oxone, 15% of sodium bromide and 30% of sodium carbonate. Experiment C again employs 105 grams of the commercial detergent composition, this time with 107 grams of Oxone bleach, which bleach consists of 49% of Oxone, 13% of sodium bromide, 26% of sodium carbonate and 12% of p-toluenesulfonamide.

The above experiments have theoretical active oxygen contents in the wash-bleach solution of 45 p.p.m. (A); 33 p.p.m. (B); and 33 p.p.m. (C). Evaluation of the various washed materials establishes that Composition C, a composition within the present invention (both bleaches and bleaching detergents are within the invention), is safest to the colors of dyed fabrics and also is most effective in brightening white cotton fabric whereas the composition of Experiment B is least effective in such characteristics. Stain removal by the composition of Experiment C is generally less than that obtained with Compositions A and B but in view of the improved safety to colors and stability and substantivity of the fluorescent brightener to the washed fabrics removal of stains by Composition C is acceptable and the total result, including stain removal, color safety and optical whitening effect, is superior. Table VII shows the data obtained from reflectormeter readings of the test swatches before and after bleach-washing.

TABLE VII

| Stains | Fabrics | Stain Removal (%) A | B | C |
|---|---|---|---|---|
| Coffee/Tea | Cotton | 89 | 92 | 80 |
| Red Wine | Cotton | 95 | 96 | 83 |
| Sulfo Dye | Cotton | 72 | 81 | 28 |
| Blood, Milk, Ink Mixture | Cotton | 54 | 14 | 7 |
| Tea | Cotton | 92 | 93 | 85 |
| Coffee | Cotton | 91 | 93 | 81 |
| Blueberry | Cotton | 94 | 95 | 88 |
| Cocoa | Cotton | 93 | 88 | 50 |
| Grape | Cotton | 94 | 95 | 90 |
| Tea | Polyester/Cotton | 91 | 93 | 79 |
| Coffee | Polyester/Cotton | 88 | 86 | 77 |
| Blueberry | Polyester/Cotton | 90 | 92 | 75 |
| Cocoa | Polyester/Cotton | 92 | 87 | 48 |
| Grape | Polyester/Cotton | 93 | 94 | 80 |

The pH's of the wash waters at the ends of the treatments are each 9.4. Essentially the same results are obtained when, in Experiments B and C, $KHSO_5$ is employed instead of Oxone in an equivalent proportion as a source of active oxygen.

EXAMPLE 9

The following bleach-detergent composition is prepared, with a particle size in the 8 to 100 mesh, U.S. Standard Sieve Series, range:

| | Parts |
|---|---|
| Linear sodium tridecylbenzene sulfonate | 13 |
| Sodium tripolyphosphate | 24 |
| Sodium silicate ($Na_2$:$SiO_2$ = 1:2.4) | 7 |
| Sodium carboxymethyl cellulose | 0.5 |
| Fluorescent brightener (Phorwite BHC) | 0.3 |
| Perfume | 0.2 |
| Sodium carbonate | 17 |
| Sodium bromide | 5 |
| Oxone (4.3% active oxygen) | 20 |
| p-Toluenesulfonamide | 3 |
| Water | 10 |

In laboratory Terg-o-Tometer tests at 1.5 g./l. at 32°-60° C. and in machine wash tests (100 g./67 l. of 49° C. tap water) the bleaching detergent product is highly effective in the removal of stains from cotton and 65% polyester - 35% cotton fabrics. In washing mixed white and colored items greater safety to the white items against dye transfer from the colored items of fabrics dyed with colors that are highly fugitive in detergent solutions, even without bleach being present, is obtained by use of the described bleaching detergent. Such results are also obtained when the pentasodium tripolyphosphate is replaced by an equal amount of molecular sieve zeolite, e.g., type 4A, containing 18% of water of hydration.

EXAMPLE 10

The composition of Example 9 and similar compositions containing Oxone, sodium bromide and TSA in a commercial detergent of the type described are aged at 43° C. in moisture barrier containers. Both glass containers and laminated cartons having an outer wax surface are employed. Aging takes place for periods as long as 12 weeks. After such aging stain removal tests on the aged samples give the same bleaching, color stability, etc., results as for freshly formulated compositions. Also, titration of the aged sample shows very little, if any, loss of active oxygen. A further advantage of the product is that the aged compositions remain free-flowing and non-caked.

EXAMPLE 11

Three bleaching or bleaching detergent compositions are made, each of which consists of 0.30 g. of Oxone (4.3% active oxygen), 0.075 g. of sodium bromide, 0.045 g. of p-toluenesulfonamide and 0.26 g. of hydrated type 4A synthetic molecular sieve zeolite (water content of about 20%). In Experiment A this mix is further mixed with 0.26 g. of sodium carbonate. In Experiment B it is mixed with 1.50 parts of the commercial spray dried detergent of Example 2, containing 32% of sodium tripolyphosphate. In Experiment C the 0.68 g. of the mix is further mixed with 1.5 g. of a commercial non-phosphate detergent consisting of 18% of sodium linear dodecylbenzene sulfonate, 38.7% of sodium sulfate, 4.0% of $C_{16-18}$ fatty alcohol ethoxylate containing 10.3 mols of ethylene oxide per mol of fatty alcohol, 25% of sodium silicate ($Na_2O:SiO_2$ = 1:2.4), 1% of sodium carboxymethyl cellulose, 6% of 80:20 tallow:coco soap, 1% of flow-promoting clay, 0.05% of ultramarine blue, 0.83% of mixed dye and fluorescent brightener (Polar Brilliant Blue and Tinopal 5 BM Conc.) and 4.5% of water. Such non-phosphate detergent is spray dried except for the post-addition of half of the nonionic detergent and all of the perfume and flow-promoting clay. The balance of the composition may be of minor adjuvants, sodium sulfate and water.

0.94 g. Of Composition A, 2.18 g. of Composition B and 2.18 g. of Composition C are each added to separate liters of 49° C. water in Terg-o-Tometers set at 100 r.p.m. and 49° C. Two swatches each of stained and unbrightened clean cotton fabrics measuring 6 × 8 cm. each are added immediately and after a 15 minute bleaching wash the swatches are rinsed and dried and stain removal and whiteness retention of the clean swatches are determined from reflectance readings taken with the Gardner Color Meter before and after washing. The results, described in Table VIII, which follows, indicate that with respect to coffee/tea stains each of the compositions is of about of the same effectiveness whereas for red wine and sulfo dye removal Composition B is most effective. Whiteness retention is acceptable for all the products and is best for Composition C. The pH's at the ends of the wash periods are 9.2, 7.7 and 9.1, respectively for Experiments A, B and C.

TABLE VIII

| Test Swatches and Stains | Reflectance Change, ΔRd | | |
|---|---|---|---|
| | A | B | C |
| Coffee/Tea | 7.2 | 7.4 | 7.4 |
| Red Wine | 13.9 | 23.1 | 20.1 |
| Sulfo Dye | 3.3 | 5.2 | 3.7 |
| Non-Stained White | −0.3 | 0.1 | 0.3 |

EXAMPLE 12

Four bleaching detergent compositions, three with different amounts of N-hydrogen compound and the fourth with no such compound present, and a control detergent composition are tested in Experiments A-E for stain removal (coffee/tea) and safety to dyed materials (blue percale Monticello sheet material). The control composition (A) is 1.5 grams of the heavy duty commercial detergent of Example 2 and the bleaching detergent composition containing no N-hydrogen compound (B) consists of 1.11 g. of such detergent, 0.3 g. of Oxone (4.3% active oxygen) and 0.09 g. sodium bromide. Compositions C-E include 0.04 g., 0.07 g., and 0.15 g., respectively, of TSA plus the 1.5 g. of the composition of Experiment B.

The test fabrics employed are three 8 × 15 cm. swatches stained with coffee/tea and three 8 × 15 cm. swatches of the blue sheet material. Washings are effected in the Terg-o-Tometer at 49° C. (similar results are obtained at room temperature and at 65° C.) in one liter Terg-o-Tometer "tubs" for periods of 15 minutes and 30 minutes, respectively. Gardner Color Meter values ΔR*d* and Δ*b* are determined and tabulated. Such values, given in Table IX, indicate that the Oxone-bromide combination, without TSA, promotes strong bleaching of coffee/tea stains but that in the presence of TSA bleach performance is slightly poorer. However, with blue percale fabric, dye stabilities are greater with Compositions C-E and such dye stabilities are essentially the same as that for the control, with Compositions D and E. After the 15 or 30 minute wash period the residual active oxygen in the wash solution is greater for the Oxone-bromide detergent solutions with TSA than for those without it and when the wash period is extended bleach compositions containing TSA remove coffee/tea stains nearly as well as does the bleach product without TSA. Thus, the N-hydrogen compound has a decided effect on improving safety to dyed materials being washed while at the same time allowing effective bleaching.

In the preceding examples, omissions of the builder salts from the bleaching detergents diminishes cleaning ability but the relative cleaning powers and safeties of the various compositions described are in substantially the same order as previously given.

TABLE IX

| Washing Times, Fabrics and Reflectance Characteristics Types | A | B | C | D | E |
|---|---|---|---|---|---|
| 15 Minutes Wash | | | | | |
| Coffee/Tea on Cotton | | | | | |
| ΔRd | 1.9 | 15.8 | 14.4 | 12.9 | 12.4 |
| Blue Percale | | | | | |
| ΔRd | 0.4 | 1.4 | 1.1 | 0.6 | 0.5 |
| Δb | −0.5 | 1.3 | 0.5 | −0.7 | −0.4 |
| 30 Minutes Wash | | | | | |
| Coffee/Tea on Cotton | | | | | |
| ΔRd | 2.2 | 15.7 | 15.2 | 13.7 | 14.1 |
| Blue Percale | | | | | |
| ΔRd | 0.6 | 2.8 | 1.8 | 0.8 | 0.5 |
| Δb | −0.3 | 3.4 | 2.1 | −0.4 | −0.6 |

The invention has been described with respect to various illustrations of specific embodiments thereof but it is evident that one of skill in the art, with the present specification before him, will be able to utilize substitutes and equivalents without departing from the invention and the teachings herein.

What is claimed is:

1. A bleaching composition consisting essentially of about 5 to 25 parts by weight of a water soluble peroxymonosulfate bleach, about 3 to 20 parts by weight of a water soluble inorganic bromide, in sufficient quantity to promote the bleaching activity of the peroxymonosulfate and about 2 to 30 parts by weight of an aromatic sulfonamide compound selected from the group consisting of benzene sulfonamide, toluene sulfonamide, ethylbenzene sulfonamide, dodecylbenzene sulfonamide and xylene sulfonamide, N-alkali metal salts of said sulfonamides, N-acetyl and N-benzoyl derivatives of said sulfonamides and of said salts of said sulfonamides and mixtures of such sulfonamides, salts and derivatives, which inhibits destruction of dyes and overbleaching of dyed materials while stains to be bleached by the composition are effectively removed from substrates.

2. A composition according to claim 1 which includes from about 0.5 to 10 parts by weight of a triazinylamino fluorescent brightener selected from the group consisting of 4,4'-bis-(4-anilino-6-methyl-ethanol-S-triazin-2-ylamino)-2,2'-stilbenedisulfonic acid, disodium salt; 4,4'-bis-(4-anilino-6-morpholine-S-triazin-2-ylamino)-2,2'-stilbenedisulfonic acid, sodium salt; 4,4'-bis-(4-anilino-6-diethanol-S-triazin-2-ylamino)-2,2'-stilbenedisulfonic acid, disodium salt; and mixtures thereof, which is stable in aqueous media in which the other components of the bleaching composition are dissolved and the fluorescent intensity of which is lowered in aqueous media in which the peroxymonosulfate bleach and the bleach promoting quantity of bromide are dissolved, when the aromatic sulfonamide compound is absent.

3. A composition according to claim 1 wherein the peroxymonosulfate bleach is an alkali metal peroxymonosulfate, the bromide is an alkali metal bromide and the aromatic sulfonamide compound is toluene sulfonamide or an N-alkali metal salt thereof.

4. A composition according to claim 3 wherein the aromatic sulfonamide compound is para-toluene sulfonamide, ortho-toluene sulfonamide or a mixture thereof.

5. A composition according to claim 4 wherein the aromatic sulfonamide compound is para-toluene sulfonamide.

6. A composition according to claim 4 which includes from about 0.5 to 10 parts by weight of a triazinylamino fluorescent brightener selected from the group consisting of 4,4'-bis-(4-anilino-6-methyl-ethanol-S-triazin-2-ylamino)-2,2'-stilbenedisulfonic acid, disodium salt; 4,4'-bis-(4-anilino-6-morpholine-S-triazin-2-ylamino)-2,2'-stilbenedisulfonic acid, disodium salt; 4,4'-bis-(4-anilino-6-diethanol-S-triazin-2-ylamino)-2,2'-stilbenedisulfonic acid, disodium salt; and mixtures thereof, which is stable in aqueous media in which the other components of the bleaching composition are dissolved and the fluorescent intensity of which is lowered in aqueous media in which the peroxymonosulfate bleach and the bleach promoting quantity of bromide are dissolved, when the aromatic sulfonamide compound is absent.

7. A composition according to claim 6 wherein the peroxymonosulfate is potassium peroxymonosulfate in a mixed salt of the formula $2KHSO_5.KHSO_4.K_2SO_4$, the alkali metal bromide is sodium bromide, the aromatic sulfonamide compound is para-toluene sulfonamide and the fluorescent brightener is 4,4'-bis-(4-anilino-6-methyl-ethanol-S-triazin-2-ylamino)-2,2'-stilbenedisulfonic acid, disodium salt and the proportions by weight of peroxymonosulfate:bromide:sulfonamide compound:-fluorescent brightener are about 10 to 20, 5 to 15, 5 to 15 and 0.5 to 2, respectively.

8. A bleaching detergent composition consisting essentially of about 5 to 50 parts by weight of normally solid, water soluble synthetic organic detergent, about 5 to 25 parts by weight of water soluble peroxymonosulfate bleach, about 3 to 20 parts by weight of water soluble inorganic bromide, in sufficient quantity to promote the bleaching activity of the peroxymonosulfate and about 2 to 30 parts by weight of an aromatic sulfonamide compound selected from the group consisting of benzene sulfonamide, toluene sulfonamide, ethylbenzene sulfonamide, dodecylbenzene sulfonamide and xylene sulfonamide, N-alkali metal salts of said sulfonamides, N-acetyl and N-benzoyl derivatives of said sulfonamides and of said salts of said sulfonamides and mixtures of such sulfonamides, salts and derivatives, which inhibits destruction of dyes and overbleaching of dyed materials while stains to be bleached by the bleaching detergent composition are effectively removed from substrates.

9. A composition according to claim 8 wherein the synthetic organic detergent is selected from the group consisting of anionic and nonionic detergents and mixtures thereof, the peroxymonosulfate is an alkali metal peroxymonosulfate, the bromide is an alkali metal bromide and the aromatic sulfonamide compound is toluene sulfonamide or an N-alkali metal salt thereof, and which includes about 10 to 100 parts of a builder salt.

10. A composition according to claim 9 wherein the anionic detergent is sodium linear higher alkylbenzene sulfonate in which the higher alkyl is of 12 to 15 carbon atoms, the nonionic detergent is a higher fatty alcohol polyethylene oxide condensate in which the higher fatty alcohol is of 12 to 15 carbon atoms and the molar ratio of ethoxy groups to higher alkyl is in the range of 9 to 13, the peroxymonosulfate is potassium peroxymonosulfate in a mixed salt of the formula $2KHSO_5.KHSO_4.K_2SO_4$, the alkali metal bromide is sodium bromide, the aromatic sulfonamide compound is para-toluene sulfonamide and the builder salt is selected from the group consisting of tetrasodium pyrophosphate, pentasodium tripolyphosphate, sodium citrate, sodium bicarbonate, sodium carbonate, potassium carbonate, sodium silicate of $Na_2O:SiO_2$ ratio in the range of 1 to 2.4 and trisodium nitrilotriacetate, and mixtures thereof wherein the proportions by weight of synthetic organic detergent:potassium peroxymonosulfate:sodium bromide:para-toluene sulfonamide:builder salts are 10 to 25:5 to 25:3 to 20:2 to 30:20 to 50:, respectively, and which contains from about 0.5 to 10 parts by weight of a fluorescent brightener which is 4,4'-bis-(4-anilino-6-methyl-ethanol-S-triazin-2-ylamino)-2,2'-stilbene disulfonic acid, disodium salt.

* * * * *